US009673520B2

(12) United States Patent
Zhang et al.

(10) Patent No.: US 9,673,520 B2
(45) Date of Patent: Jun. 6, 2017

(54) MULTI-BAND WIRELESS TERMINALS WITH MULTIPLE ANTENNAS ALONG AN END PORTION, AND RELATED MULTI-BAND ANTENNA SYSTEMS

(75) Inventors: Shuai Zhang, Lund (SE); Sailing He, Åkersberga (SE); Kun Zhao, Stockholm (SE); Zhinong Ying, Lund (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 188 days.

(21) Appl. No.: 13/247,358

(22) Filed: Sep. 28, 2011

(65) Prior Publication Data

US 2013/0076579 A1 Mar. 28, 2013

(51) Int. Cl.

| | |
|---|---|
| ***H01Q 1/52*** | (2006.01) |
| ***H01Q 5/00*** | (2015.01) |
| ***H01Q 1/24*** | (2006.01) |
| ***H01Q 1/38*** | (2006.01) |
| ***H01Q 9/42*** | (2006.01) |
| ***H01Q 21/28*** | (2006.01) |
| ***H01Q 25/00*** | (2006.01) |
| ***H01Q 5/364*** | (2015.01) |

(52) U.S. Cl.

CPC ..... *H01Q 1/521* (2013.01); *H01Q 1/243* (2013.01); *H01Q 1/38* (2013.01); *H01Q 5/364* (2015.01); *H01Q 9/42* (2013.01); *H01Q 21/28* (2013.01); *H01Q 25/00* (2013.01)

(58) Field of Classification Search

USPC ..... 343/700 MS, 702, 720, 833, 834, 835, 343/893, 815, 817, 818, 819, 836, 837

See application file for complete search history.

(56) References Cited

U.S. PATENT DOCUMENTS

| | | | | |
|---|---|---|---|---|
| 4,814,777 | A * | 3/1989 | Monser | H01Q 21/205 343/727 |
| 6,433,745 | B1 * | 8/2002 | Nagumo | H01Q 1/243 343/700 MS |
| 6,674,411 | B2 * | 1/2004 | Boyle | H01Q 1/243 343/700 MS |
| 6,927,731 | B2 * | 8/2005 | Leclerc | H01Q 1/243 343/702 |
| 6,963,310 | B2 * | 11/2005 | Horita et al. | 343/702 |

(Continued)

FOREIGN PATENT DOCUMENTS

| | | |
|---|---|---|
| EP | 2 006 953 A1 | 12/2008 |
| EP | 2 083 472 A1 | 7/2009 |
| EP | 2 328 228 A1 | 6/2011 |

OTHER PUBLICATIONS

European Search Report Corresponding to European Application No. 12178055.5; Dated: Nov. 15, 2012; 7 Pages.

(Continued)

*Primary Examiner* — Tho G Phan
*Assistant Examiner* — Patrick Holecek
(74) *Attorney, Agent, or Firm* — Myers Bigel, P.A.

(57) ABSTRACT

An antenna system may include a backplate that includes an end portion. The antenna system may also include first and second antennas spaced apart from each other along the end portion of the backplate. The antenna system may additionally include a parasitic element between the first and second antennas along the end portion of the backplate.

16 Claims, 18 Drawing Sheets

(56) References Cited

U.S. PATENT DOCUMENTS

| | | | | |
|---|---|---|---|---|
| 7,167,130 | B2 * | 1/2007 | Hayes | 343/702 |
| 7,538,732 | B2 * | 5/2009 | Ishihara et al. | 343/702 |
| 7,683,839 | B2 * | 3/2010 | Ollikainen | H01Q 1/243 343/700 MS |
| 7,825,863 | B2 * | 11/2010 | Martiskainen et al. | 343/702 |
| 8,823,590 | B2 * | 9/2014 | Tseng | H01Q 1/243 343/700 MS |
| 2008/0198082 | A1 * | 8/2008 | Soler Castany et al. | 343/770 |
| 2009/0174611 | A1 * | 7/2009 | Schlub et al. | 343/702 |
| 2010/0220030 | A1 * | 9/2010 | Shimoda et al. | 343/860 |
| 2013/0016024 | A1 * | 1/2013 | Shi | H01Q 1/243 343/833 |

OTHER PUBLICATIONS

Chen et al., Broadband Planar Antennas Design and Applications, 2006, pp. 139-141, John Wiley & Sons, Ltd.

* cited by examiner

| COMPLEX CORRELATION COEFFICIENT | | EFFICIENCY(%) |
|---|---|---|
| 0.76 (GHz) | 0.78 | 48 |
| 0.77 (GHz) | 0.74 | 50 |
| 0.79 (GHz) | 0.64 | 52 |
| 0.85 (GHz) | 0.46 | 54 |
| 0.87 (GHz) | 0.43 | 54 |
| 0.93 (GHz) | 0.27 | 57 |
| 0.95 (GHz) | 0.27 | 51 |
| 0.96 (GHz) | 0.26 | 43 |

| COMPLEX CORRELATION COEFFICIENT | | EFFICIENCY(%) |
|---|---|---|
| 1.7 (GHz) | 0.24 | 62 |
| 1.8 (GHz) | 0.02 | 75 |
| 1.9 (GHz) | 0.001 | 75 |
| 2.1 (GHz) | 0.01 | 74 |
| 2.3 (GHz) | 0.01 | 79 |
| 2.5 (GHz) | 0 | 83 |
| 2.6 (GHz) | 0.002 | 78 |
| 2.7 (GHz) | 0.01 | 68 |

*FIGURE 10*

| COMPLEX CORRELATION COEFFICIENT | | EFFICIENCY(%) |
|---|---|---|
| 0.85 (GHz) | 0.69 | 51 |
| 0.88 (GHz) | 0.61 | 51 |
| 0.9 (GHz) | 0.58 | 51 |
| 0.92 (GHz) | 0.53 | 49 |
| 0.95 (GHz) | 0.46 | 49 |
| 0.96 (GHz) | 0.41 | 44 |

| COMPLEX CORRELATION COEFFICIENT | | EFFICIENCY(%) |
|---|---|---|
| 1.7 (GHz) | 0.39 | 58 |
| 1.8 (GHz) | 0.02 | 80 |
| 2 (GHz) | 0.001 | 78 |
| 2.3 (GHz) | 0.02 | 79 |
| 2.4 (GHz) | 0.01 | 79 |
| 2.5 (GHz) | 0.01 | 71 |

*FIGURE 13*

| COMPLEX CORRELATION COEFFICIENT | | EFFICIENCY(%) |
|---|---|---|
| 0.85 (GHz) | 0.69 | 51 |
| 0.86 (GHz) | 0.65 | 51 |
| 0.9 (GHz) | 0.55 | 53 |
| 0.93 (GHz) | 0.48 | 50 |
| 0.95 (GHz) | 0.47 | 50 |
| 0.96 (GHz) | 0.44 | 45 |

| COMPLEX CORRELATION COEFFICIENT | | EFFICIENCY(%) |
|---|---|---|
| 1.7 (GHz) | 0.32 | 60 |
| 1.8 (GHz) | 0.01 | 78 |
| 2 (GHz) | 0.02 | 75 |
| 2.2 (GHz) | 0.03 | 77 |
| 2.4 (GHz) | 0.01 | 77 |
| 2.5 (GHz) | 0.01 | 70 |

*FIGURE 15*

MULTI-BAND WIRELESS TERMINALS WITH MULTIPLE ANTENNAS ALONG AN END PORTION, AND RELATED MULTI-BAND ANTENNA SYSTEMS

FIELD

The present inventive concept generally relates to the field of communications and, more particularly, to antennas and wireless terminals incorporating the same.

BACKGROUND

Wireless terminals may operate in multiple frequency bands (i.e., "multi-band") to provide operations in multiple communications systems. For example, many cellular radiotelephones are designed for operation in Global System for Mobile Communications (GSM), Wideband Code Division Multiple Access (WCDMA), and Third Generation Partnership Project (3GPP) Long Term Evolution (LTE) modes at nominal frequencies such as 850 Megahertz (MHz), 900 MHz, 1800 MHz, 1900 MHz, and/or 2100 MHz.

Achieving effective performance in multiple frequency bands may be difficult. For example, contemporary wireless terminals are increasingly including more circuitry and larger displays and keypads/keyboards within small housings. Constraints on the available space and locations for antennas in wireless terminals can negatively affect antenna performance.

For example, although wireless terminals may include multiple antennas, mutual coupling between different antennas may degrade performance. Moreover, if a wireless terminal uses its chassis as a shared radiator for multiple antennas operating in low frequency bands (e.g., below about one (1.0) Gigahertz (GHz)), then mutual coupling may particularly degrade performance in the low frequency bands.

SUMMARY

Some embodiments of the present inventive concept include a multi-band wireless communications terminal. The multi-band wireless communications terminal may include a backplate covering a multi-band transceiver circuit configured to provide communications for the multi-band wireless communications terminal via a plurality of frequency bands. The multi-band wireless communications terminal may also include first and second antennas spaced apart from each other along an end portion of the backplate, wherein the multi-band transceiver circuit is configured to communicate through the first and second antennas via the plurality of frequency bands. The multi-band wireless communications terminal may further include a parasitic element between the first and second antennas along the end portion of the backplate.

In some embodiments, each of the first and second antennas may include a radiating element and a scattering element configured to reflect radiation from the radiating element.

In some embodiments, each of the first and second antennas may include first and second spaced-apart portions, the first portion partially surrounding the second portion.

In some embodiments, a first side section of the first portion may be between the second portion and the parasitic element. Also, a second side section of the first portion may be spaced apart from the second portion. Additionally, an end section between the first and second side sections of the first portion may be spaced apart from the second portion.

In some embodiments, the second side section of the first portion may be spaced apart from the second portion by less than about 0.8 millimeters. Also, the end section between the first and second side sections of the first portion may be spaced apart from the second portion by less than about 1.4 millimeters.

In some embodiments, the first portion may surround a majority of a perimeter of the second portion.

In some embodiments, the multi-band wireless communications terminal may further include a speaker on the parasitic element between the first and second antennas along the end portion of the backplate.

In some embodiments, the multi-band wireless communications terminal may further include an antenna housing configured to cover the first and second antennas, and further configured to provide an acoustic cavity for the speaker.

In some embodiments, the multi-band wireless communications terminal may further include a third antenna on the parasitic element between the first and second antennas.

In some embodiments, the third antenna may include a Global Positioning System (GPS) antenna.

In some embodiments, the multi-band wireless communications terminal may further include a dielectric block along the end portion of the backplate, wherein the first and second antennas and the parasitic element are on the dielectric block.

In some embodiments, each of the first and second antennas may be on first and second sides of the dielectric block. Also, the first side of the dielectric block may be substantially parallel with a primary surface of the backplate. Moreover, the second side of the dielectric block may include an outer edge of the dielectric block.

In some embodiments, the first side of the dielectric block may include a perimeter portion that shares a boundary with a perimeter portion of the end portion of the backplate.

In some embodiments, the dielectric block may have a width of less than about 55.0 millimeters and a thickness of less than about 5.0 millimeters.

In some embodiments, the first and second antennas may include printed metals.

In some embodiments, the parasitic element may include a printed metal film.

A multi-band wireless communications terminal according to some embodiments may include a backplate covering a multi-band transceiver circuit configured to provide communications for the multi-band wireless communications terminal via a plurality of frequency bands. The multi-band wireless communications terminal may also include a dielectric material along an end portion of the backplate. The multi-band wireless communications terminal may additionally include first and second antennas spaced apart from each other on the dielectric material, each of the first and second antennas including a radiating element and a scattering element configured to reflect radiation from the radiating element, where the multi-band transceiver circuit is configured to communicate through the first and second antennas via the plurality of frequency bands. The multi-band wireless communications terminal may further include a parasitic metal strip between the first and second antennas on the dielectric material.

A multi-band antenna system according to some embodiments may include a backplate that includes first and second end portions. The multi-band antenna system may also include first and second antennas spaced apart from each other along the first end portion of the backplate. The multi-band antenna system may further include a parasitic element between the first and second antennas along the first end portion of the backplate.

In some embodiments, the multi-band antenna system further includes a dielectric block along the first end portion of the backplate. The first and second antennas and the parasitic element may be on the dielectric block. Also, each of the first and second antennas may include a radiating element and a scattering element configured to reflect radiation from the radiating element.

In some embodiments, the backplate may include a metal backplate. Also, the first and second antennas may include printed metals. Moreover, the parasitic element may include a printed metal film.

Other devices and/or systems according to embodiments of the inventive concept will be or become apparent to one with skill in the art upon review of the following drawings and detailed description. It is intended that all such additional devices and/or systems be included within this description, be within the scope of the present inventive concept, and be protected by the accompanying claims. Moreover, it is intended that all embodiments disclosed herein can be implemented separately or combined in any way and/or combination.

BRIEF DESCRIPTION OF THE DRAWINGS

FIG. 10 illustrates a table of complex correlation coefficients, according to some embodiments of the present inventive concept.

FIG. 13 illustrates a table of complex correlation coefficients for a design that incorporates a dielectric box, according to some embodiments of the present inventive concept.

FIG. 15 illustrates a table of complex correlation coefficients for a design that incorporates a speaker, according to some embodiments of the present inventive concept.

DETAILED DESCRIPTION OF EMBODIMENTS

Figure 1:
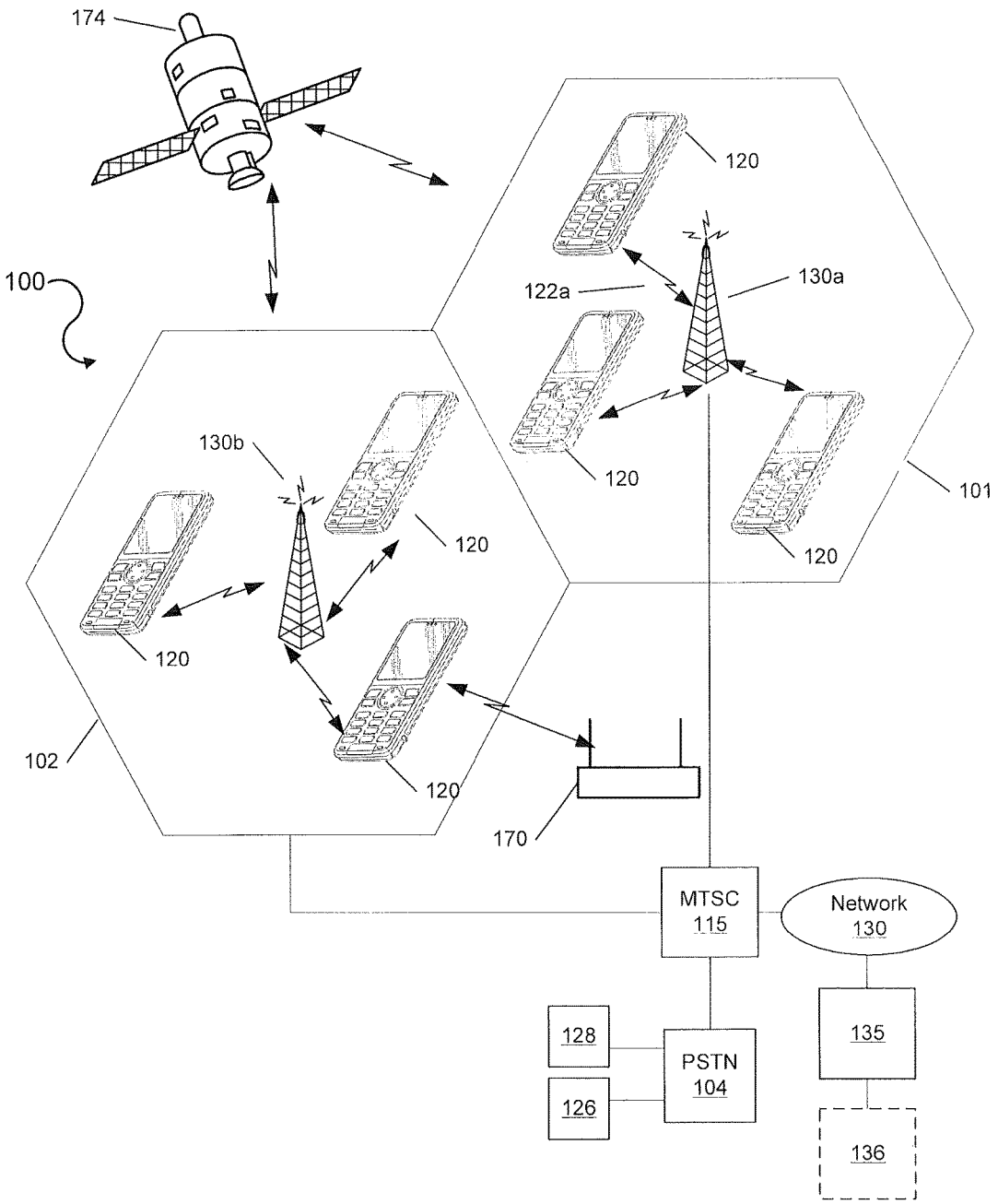
FIG. 1 is a schematic illustration of a wireless communications network that provides service to wireless terminals, according to some embodiments of the present inventive concept.

The present inventive concept now will be described more fully with reference to the accompanying drawings, in which embodiments of the inventive concept are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein the term "and/or" includes any and all combinations of one or more of the associated listed items.

Spatially relative terms, such as "above," "below," "upper," "lower," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms first, second, etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For purposes of illustration and explanation only, various embodiments of the present inventive concept are described herein in the context of multi-band wireless communication terminals ("wireless terminals"/"mobile terminals"/"terminals") that are configured to carry out cellular communications (e.g., cellular voice and/or data communications) in more than one frequency band. It will be understood, however, that the present inventive concept is not limited to such embodiments and may be embodied generally in any device and/or system that includes a multi-band Radio Frequency (RF) antenna that is configured to transmit and receive in two or more frequency bands.

Wireless terminals may not include sufficient space and locations for internally-housed antennas covering multiple bands and multiple systems. For example, some embodiments of the wireless terminals described herein may cover several frequency bands, including such frequency bands as 700-800 MHz, 824-894 MHz, 880-960 MHz, 1710-1880 MHz, 1820-1990 MHz, 1920-2170 MHz, 2300-2400 MHz, and 2500-2700 MHz. As such, as used herein, the term "multi-band" can include, for example, operations in any of the following bands: Advanced Mobile Phone Service (AMPS), ANSI-136, GSM, General Packet Radio Service (GPRS), enhanced data rates for GSM evolution (EDGE), Digital Communications Services (DCS), Personal Digital Cellular (PDC), Personal Communications Services (PCS), CDMA, wideband-CDMA, CDMA2000, and/or Universal Mobile Telecommunications System (UMTS) frequency bands. Other bands can also be used in embodiments according to the inventive concept. Also, some embodiments may be compatible with Long Term Evolution (LTE) and/or High Speed Packet Access (HSPA) standards. Some embodiments may include multiple antennas, such as a secondary antenna for Multiple Input Multiple Output (MIMO) and diversity applications. Moreover, some embodiments may provide coverage for non-cellular frequency bands such as Global Positioning System (GPS) and Wireless Local Area Network (WLAN) frequency bands.

Although some wireless terminals have included multiple antennas, the performance of these antennas has been degraded by mutual coupling between the antennas. However, some embodiments of the wireless terminals and related antenna systems described herein may provide multiple antennas having improved isolation with respect to each other. For example, multiple antennas with low correlation coefficients may provided in a relatively compact structure. In particular, the different antennas may be close together, and each antenna may both transmit and receive signals without significantly degrading performance (i.e., full MIMO performance may be achieved). Moreover, because the antennas may be close together, a shorter signal conductive path may be used, which may allow reduction in the size of the system.

Referring to FIG. 1, a diagram is provided of a wireless communications network 100 that supports communications in which wireless terminals 120 can be used, according to some embodiments of the present inventive concept. The network 100 includes cells 101, 102 and base stations 130*a*, 130*b* in the respective cells 101, 102. Networks 100 are commonly employed to provide voice and data communications to subscribers using, for example, the standards discussed above. The network 100 may include wireless terminals 120 that may communicate with the base stations 130*a*, 130*b*. The wireless terminals 120 in the network 100 may also communicate with a Global Positioning System (GPS) 174, a local wireless network 170, a Mobile Telephone Switching Center (MTSC) 115, and/or a Public Service Telephone Network (PSTN) 104 (i.e., a "landline" network).

The wireless terminals 120 can communicate with each other via the Mobile Telephone Switching Center (MTSC) 115. The wireless terminals 120 can also communicate with other terminals, such as terminals 126, 128, via the PSTN 104 that is coupled to the network 100. As also shown in FIG. 1, the MTSC 115 is coupled to a computer server 135 supporting a location service 136 (i.e., a location server) via a network 130, such as the Internet.

The network 100 is organized as cells 101, 102 that collectively can provide service to a broader geographic region. In particular, each of the cells 101, 102 can provide service to associated sub-regions (e.g., the hexagonal areas illustrated by the cells 101, 102 in FIG. 1) included in the broader geographic region covered by the network 100. More or fewer cells can be included in the network 100, and the coverage area for the cells 101, 102 may overlap. The shape of the coverage area for each of the cells 101, 102 may be different from one cell to another, and can be any shape depending upon obstructions, interference, etc. Each of the cells 101, 102 may include an associated base station 130*a*, 130*b*. The base stations 130*a*, 130*b* can provide wireless communications between each other and the wireless terminals 120 in the associated geographic region covered by the network 100.

Each of the base stations 130*a*, 130*b* can transmit/receive data to/from the wireless terminals 120 over an associated control channel. For example, the base station 130*a* in cell 101 can communicate with one of the wireless terminals 120 in cell 101 over the control channel 122*a*. The control channel 122*a* can be used, for example, to page the wireless terminal 120 in response to calls directed thereto or to transmit traffic channel assignments to the wireless terminal 120 over which a call associated therewith is to be conducted.

The wireless terminals 120 may also be capable of receiving messages from the network 100 over the respective control channel 122*a*. In some embodiments according to the inventive concept, the wireless terminals receive Short Message Service (SMS), Enhanced Message Service (EMS), Multimedia Message Service (MMS), and/or Smart-messaging™ formatted messages.

The GPS 174 can provide GPS information to the geographic region including cells 101, 102 so that the wireless terminals 120 may determine location information. The network 100 may also provide network location information as the basis for the location information applied by the wireless terminals. In addition, the location information may be provided directly to the server 135 rather than to the wireless terminals 120 and then to the server 135. Additionally or alternatively, the wireless terminals 120 may communicate with a local wireless network 170.

Figure 2:
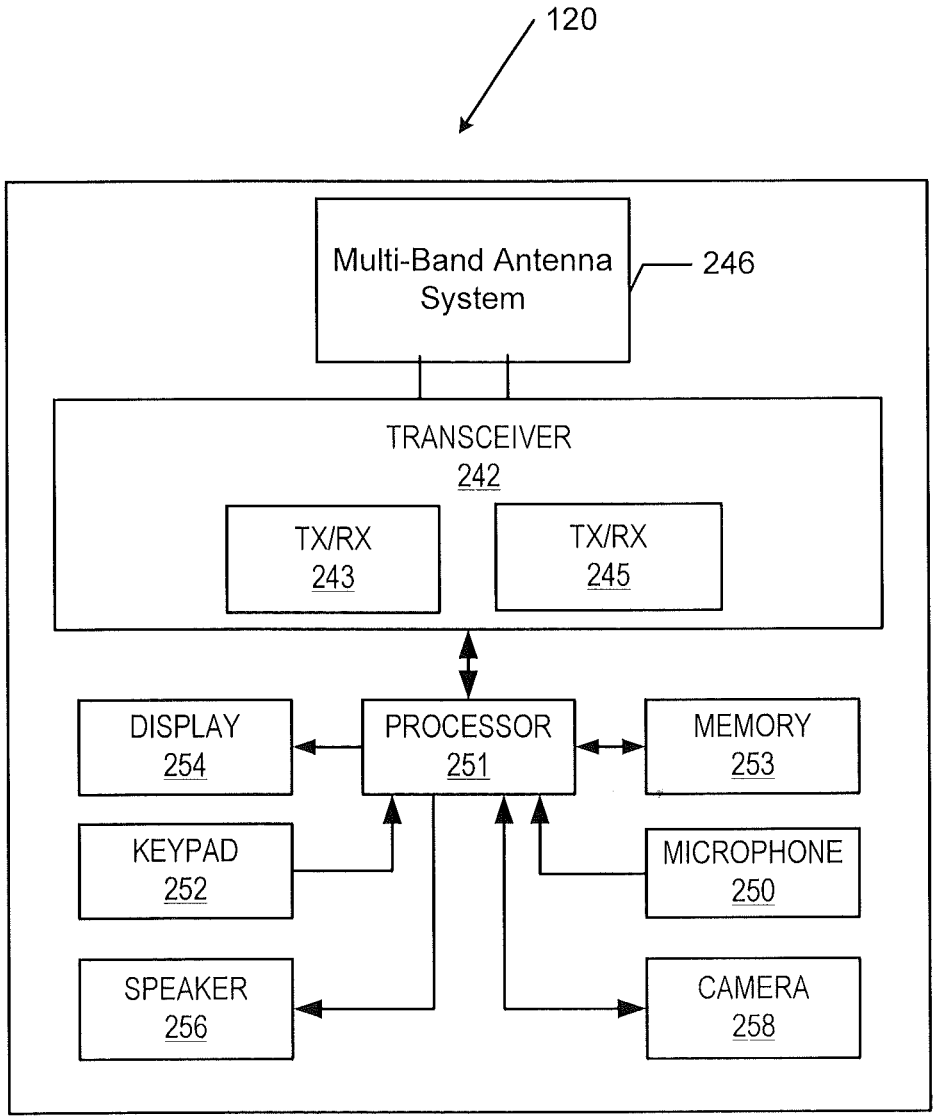
FIG. 2 is a block diagram illustrating a multi-band wireless terminal, according to some embodiments of the present inventive concept.

Referring now to FIG. 2, a block diagram is provided of a wireless terminal 120 that includes a multi-band antenna system 246, in accordance with some embodiments of the present inventive concept. As illustrated in FIG. 2, the wireless terminal 120 includes the multi-band antenna system 246, a transceiver 242, and a processor 251, and can further include a display 254, keypad 252, speaker 256, memory 253, microphone 250, and/or camera 258.

The transceiver 242 may include transmit/receive circuitry (TX/RX) that provides separate communication paths for supplying/receiving RF signals to different radiating elements of the multi-band antenna system 246 via their respective RF feeds. Accordingly, when the multi-band antenna system 246 includes two antenna elements, the transceiver 242 may include two transmit/receive circuits 243, 245 connected to different ones of the antenna elements via the respective RF feeds.

A transmitter portion of the transceiver 242 converts information, which is to be transmitted by the wireless terminal 120, into electromagnetic signals suitable for radio communications. A receiver portion of the transceiver 242 demodulates electromagnetic signals, which are received by the wireless terminal 120 from the network 100 (illustrated in FIG. 1) to provide the information contained in the signals in a format understandable to a user of the wireless terminal 120.

It will be understood that the functions of the keypad 252 and the display 254 can be provided by a touch screen through which the user can view information, such as computer displayable documents, provide input thereto, and otherwise control the wireless terminal 120.

The transceiver 242 in operational cooperation with the processor 251 may be configured to communicate according to at least one radio access technology in two or more frequency ranges. The at least one radio access technology may include, but is not limited to, WLAN (e.g., 802.11), WiMAX (Worldwide Interoperability for Microwave Access), TransferJet, 3GPP LTE (3rd Generation Partnership Project Long Term Evolution), Universal Mobile Telecommunications System (UMTS), Global Standard for Mobile (GSM) communication, General Packet Radio Service (GPRS), enhanced data rates for GSM evolution (EDGE), DCS, PDC, PCS, code division multiple access (CDMA), wideband-CDMA, and/or CDMA2000. Other radio access technologies and/or frequency bands can also be used in embodiments according to the inventive concept. In some embodiments according to the inventive concept, the local wireless network 170 (illustrated in FIG. 1) is a WLAN compliant network. In some other embodiments according to the inventive concept, the local wireless network 170 is a Bluetooth compliant interface.

Referring still to FIG. 2, a memory 253 can store computer program instructions that, when executed by the processor circuit 251, carry out the operations described herein and shown in the figures. The memory 253 can be non-volatile memory, such as EEPROM (flash memory), that retains the stored data while power is removed from the memory 253.

Figure 3A:
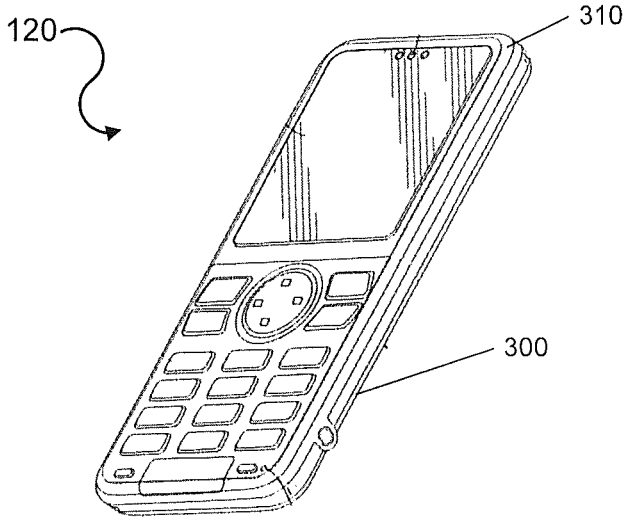
FIGS. 3A and 3B illustrate front and rear views, respectively, of a multi-band wireless terminal, according to some embodiments of the present inventive concept.
Figure 3B:
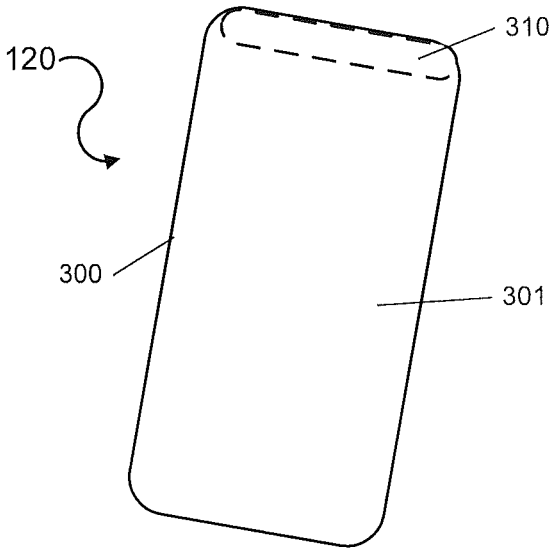

Referring now to FIGS. 3A and 3B, front and rear views, respectively, of the wireless terminal 120 are provided, according to some embodiments of the present inventive concept. Accordingly, FIGS. 3A and 3B illustrate opposite sides of the wireless terminal 120. In particular, FIG. 3B illustrates an external face 301 of a backplate 300 (e.g., of a housing) of the wireless terminal 120. Accordingly, the external face 301 may be visible to, and/or in contact with, the user of the wireless terminal 120. In contrast, an internal face of the backplate 300 can include a metal layer that provides a ground plane for internal portions of the wireless terminal 120, such as the transceiver 242 (e.g., a multi-band transceiver circuit).

FIGS. 3A and 3B also illustrate an antenna portion 310 of the wireless terminal 120. The antenna portion 310 may be at least partially enclosed within the housing of the wireless terminal 120. Moreover, although the antenna portion 310 is illustrated at a top end of the wireless terminal 120, the antenna portion 310 may additionally or alternatively be at a bottom end or a side of the wireless terminal 120.

Figure 4:
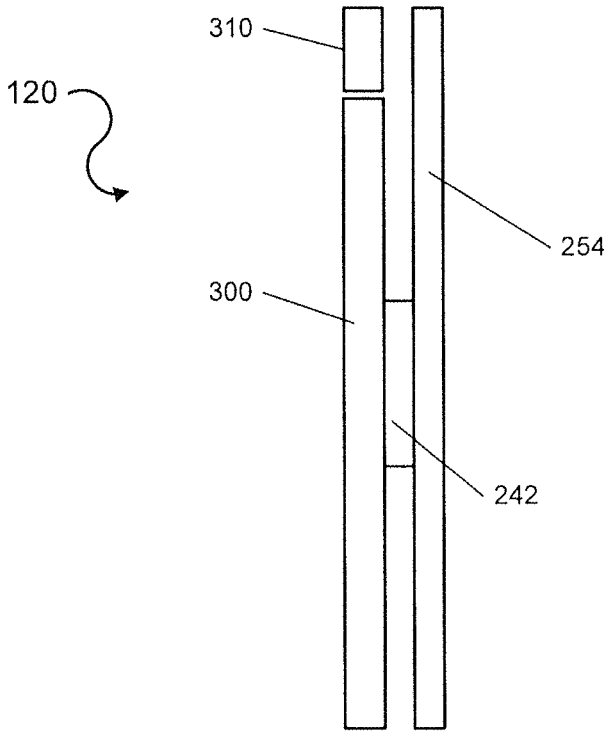
FIG. 4 illustrates a side view of some antenna components of the multi-band wireless terminal, according to some embodiments of the present inventive concept.

Referring now to FIG. 4, a side view of the wireless terminal 120 is provided, according to some embodiments of the present inventive concept. The transceiver 242 (e.g., a multi-band transceiver circuit) may be between the display 254 and the backplate 300. In some embodiments, the display 254 may be combined with the keypad 252 (illustrated in FIG. 2) as a touch screen.

In some embodiments, the antenna portion 310 may overlap the backplate 300 such that at least a portion of the antenna portion 310 is between the backplate 300 and the display 254 (e.g., the antenna portion 310 may overlap at least a portion of the internal face of the backplate 300). Alternatively, the antenna portion 310 may be adjacent the backplate 300 without overlapping the internal face of the backplate 300.

Figure 5:
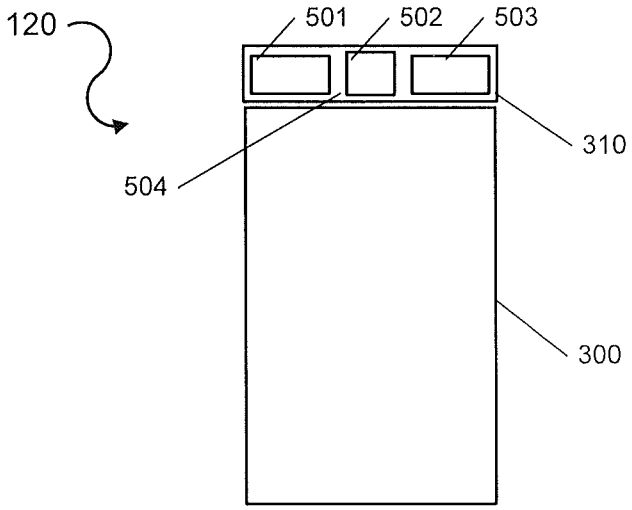
FIG. 5 illustrates a parasitic element between first and second antennas, according to some embodiments of the present inventive concept.

Referring now to FIG. 5, the antenna portion 310 of the wireless terminal 120 may include first and second antennas 501, 503, a parasitic element 502, and a dielectric material 504, according to some embodiments of the present inventive concept. The parasitic element 502 is between the first antenna 501 and the second antenna 503 adjacent/along an end portion of the backplate 300. The parasitic element 502 may reduce coupling between the first and second antennas 501, 503. The parasitic element 502 may be connected to the backplate 300 through a ground plane or through inductive tuning. Also, the parasitic element 502 may be, for example, a parasitic metal strip. In some embodiments, the parasitic element 502 is a parasitic metal film (e.g., a metal film that may be printed on a Printed Circuit Board (PCB)). Moreover, the parasitic metal film may be a flex film.

Still referring to FIG. 5, the first and second antennas 501, 503 are spaced apart from each other along the end portion of the backplate 300 of the wireless terminal 120. For example, the end portion of the backplate 300 may include a perimeter edge of the backplate 300 that borders the antenna portion 310 of the wireless terminal 120. Also, the first and second antennas 501, 503 may be spaced apart from each other on the dielectric material 504. Accordingly, the parasitic element 502 may be on the dielectric material 504 between the first and second antennas 501, 503.

The first and second antennas 501, 503 may each include a radiating element and a scattering element. The scattering element may be configured to reflect radiation from the radiating element. This reflection/scattering of radiation may enhance isolation between the first and second antennas 501, 503, especially in a low band (e.g., about 760 MHz-960 MHz).

The first and second antennas 501, 503 may be substantially identical (e.g., in terms of structure and operation) or may be substantially different. For example, each of the first and second antennas 501, 503 may include a transmitter and a receiver. Alternatively, one of the first and second antennas 501, 503 may be a receive-only antenna.

The first and second antennas 501, 503 may each be configured to resonate in at least one of the frequency bands with which the transceiver 242 (e.g., a multi-band transceiver circuit) is operable. In some embodiments, the first and second antennas 501, 503 may each be configured to resonate in one (e.g., the same one) of the frequency bands with which the transceiver 242 is operable in response electromagnetic radiation. In some embodiments, the first antenna 501 is configured to resonate in one of the frequency bands with which the transceiver 242 is operable in response electromagnetic radiation, and the second antenna 503 is configured to resonate in a different one of the frequency bands in response to different electromagnetic radiation. For example, the first antenna 501 may be configured to resonate in a band of lower frequencies than the second antenna 503.

In some embodiments, the antenna including the first antenna 501 and/or the second antenna 503 may be a multi-band antenna and/or may be configured to communicate cellular and/or non-cellular frequencies. For example, the first antenna 501 may be configured to resonate in a frequency band that includes cellular frequencies and the second antenna 503 may be configured to resonate in a frequency band that includes non-cellular frequencies. For example, the second antenna 503 may be configured as an antenna for GPS, WLAN, or Bluetooth communications, among other non-cellular frequency communications.

In some embodiments, one or more of the first and second antennas 501, 503 may include antenna metal that is printed on a PCB of the wireless terminal 120. For example, the antenna metal may be printed directly on the PCB, and then an antenna carrier (e.g., a plastic material) may be attached to the antenna portion 310 of the wireless terminal 120.

Moreover, although the first and second antennas 501, 503 and the parasitic element 502 may be included in the wireless terminal 120, they are not limited to the wireless terminal 120. For example, the first and second antennas 501, 503 and the parasitic element 502 may be included in a variety of antenna systems, some of which may not be for wireless terminals.

Figure 6:
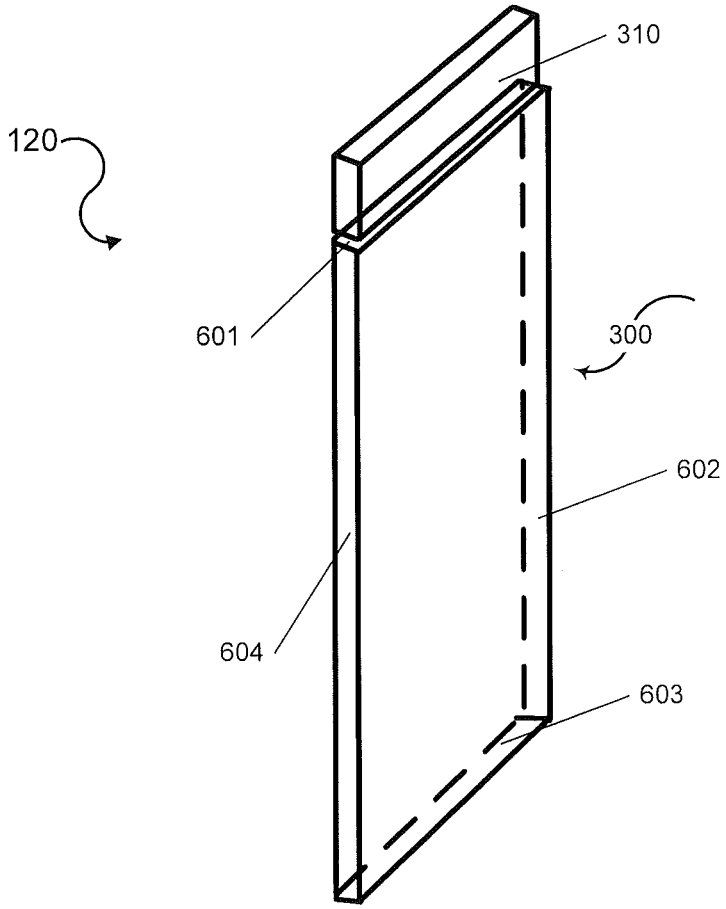
FIG. 6 illustrates a three-dimensional view of the backplate, according to some embodiments of the present inventive concept.

Referring now to FIG. 6, a three-dimensional view of the backplate 300 illustrates that the perimeter of the backplate 300 may include a top end/edge 601, a bottom end/edge 603, and first and second side edges 602, 604, according to some embodiments of the present inventive concept. Accordingly, a perimeter edge of the antenna portion 310 may share a boundary with the perimeter of the backplate 300 (e.g., with the top end 601 of the perimeter of the backplate 300). Additionally or alternatively, the antenna portion 310 may overlap portions of a primary surface (e.g., the internal face or the external face 301) of the backplate 300 near the top end 601.

Figure 7:
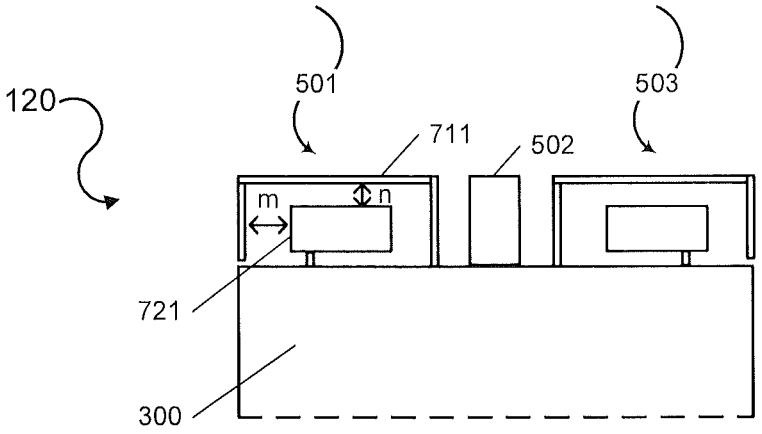
FIG. 7 illustrates a detailed view of the first and second antennas, according to some embodiments of the present inventive concept.

Referring now to FIG. 7, a detailed view of the first and second antennas 501, 503 is provided, according to some embodiments of the present inventive concept. The first and second antennas 501, 503 may each include first and second spaced-apart portions 711, 721. The first portion 711 may partially surround the second portion 721. In some embodiments, the first portion 711 may surround a majority of a perimeter of the second portion 721. For example, the first portion 711 may be substantially U-shaped, and the majority of the second portion 721 (e.g., a substantially rectangular shape) may be surrounded by the U-shaped first portion 711.

Moreover, the first portion 711 may include a first side section that is between the second portion 721 and the parasitic element 502, a second side section that is spaced apart from the second portion 721 by a distance m, and an end section that is between the first and second side sections and is spaced apart from the second portion 721 by a distance n. For example, the first and second side sections of the first portion 711 may be opposing sidewalls of a U-shape that at least partially surrounds the second portion 721. Also, the distances n and m may be less than about 1.4 millimeters (mm) and 0.8 mm, respectively. Adjusting the distances m and n may alter resonance matching in a low band (e.g., about 760 MHz-960 MHz). Additionally, adjusting the distance n may alter resonance matching in a high band (e.g., about 1.7 GHz-2.7 GHz). For example, increasing the distance n from about 0.8 mm or about 1.1 mm to about 1.4 mm may result in an improvement of a few decibels (dB) in the high band. Also, performance in the low band may improve by increasing the distance m to about 0.8 mm and by increasing the distance n to about 1.4 mm.

Figure 8:
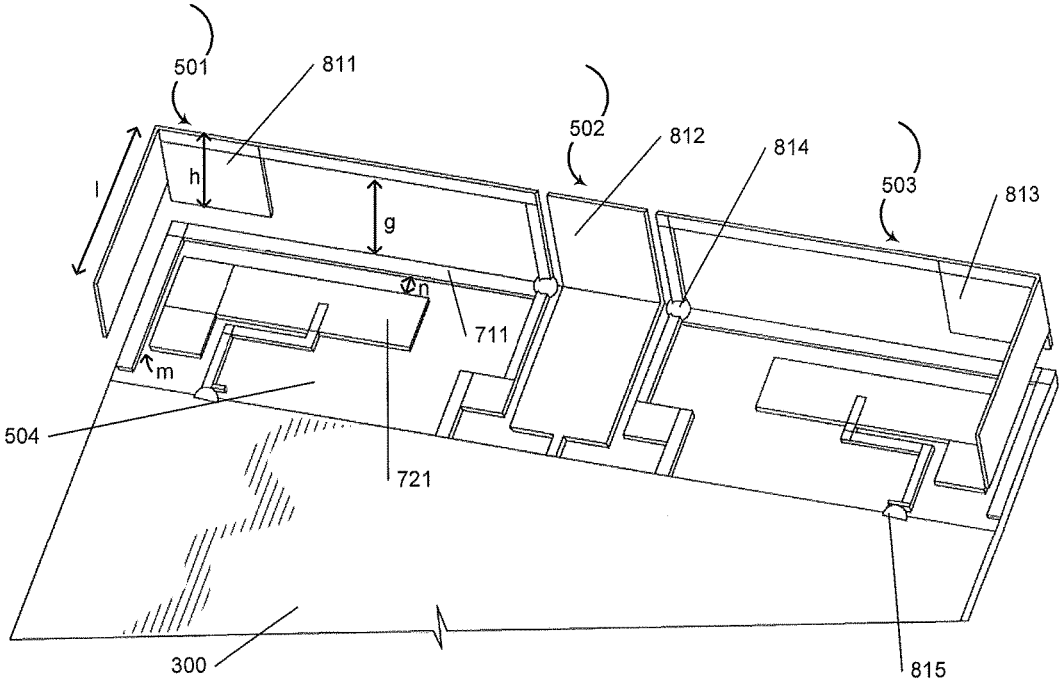
FIG. 8 illustrates a detailed three-dimensional view of the first and second antennas, according to some embodiments of the present inventive concept.

Referring now to FIG. 8, an illustration is provided of a detailed three-dimensional view of the first and second antennas 501, 503, according to some embodiments of the present inventive concept. As illustrated in FIG. 8, the first and second antennas 501, 503 and the parasitic element 502 may include vertical portions 811, 813, and 812, respectively. For example, the vertical portion 812 of the parasitic element 502 may be substantially perpendicular to a portion of the parasitic element 502 that is substantially flat on the dielectric material 504. Accordingly, the parasitic element 502 may be substantially L-shaped.

The vertical portions 811, 813 of the first and second antennas 501, 503 may be along an outer perimeter of the antenna portion 310 of the wireless terminal 120. Accordingly, the vertical portions 811, 813 of the first and second antennas 501, 503 may extend above the second side section and the end section of the first portion 711 of the first and second antennas 501, 503. A majority of the perimeter of the vertical portions 811, 813 of the first and second antennas 501, 503 may be spaced apart from the second side section and the end section of the first portion 711 of the first and second antennas 501, 503 by a gap g. However, the vertical portions 811, 813 may be connected to the horizontal portions of the first and second antennas 501, 503 at one or more points. For example, the vertical portions 811, 813 may also be connected to the horizontal portions by an inductor 814. The vertical portions 811, 813 may thereby be connected to the horizontal portions at a point near, but spaced apart from, the parasitic element 502 (e.g., at an intersection of the second side section and the end section of the first portion 711).

Furthermore, referring to FIGS. 7 and 8, the first side section of the first portion 711 of the first and second antennas 501, 503 may be connected to the backplate 300, whereas the second side section of the first portion 711 may be spaced apart from the backplate 300 (e.g., by the dielectric material 504). Moreover, the second portion 721 may extend to connect to the backplate 300 (e.g., by a feeding element 815). The feeding element 815 may determine a resonance frequency of a high band (e.g., frequencies between about 1.7 GHz and about 2.7 GHz). For example, changing the size of the feeding element 815 may change the resonant frequency of the high band. Additionally, energizing the parasitic element 502 may reduce mutual coupling between the first and second antennas 501, 503 in the high band.

In some embodiments, the first and second antennas 501, 503 may have substantially identical/symmetrical structures. In other words, the first and second antennas 501, 503 (including the horizontal portions and the vertical portions 811, 813) may be structural mirror images of one another. Alternatively, the horizontal portions and/or the vertical portions 811, 813 of the first and second antennas 501, 503 may be structurally asymmetrical.

Still referring to FIG. 8, the first side section of the first portion 711 of the first and second antennas 501, 503 may determine a first resonance frequency (e.g., about 800 MHz) of a low band (e.g., about 760 MHz-960 MHz). The second side section of the first portion 711 of the first and second antennas 501, 503 may determine a second resonance frequency (e.g., about 930 MHz) of the low band (e.g., about 760 MHz-960 MHz). Also, the first side section of first portion 711 of the first and second antennas 501, 503 may scatter/reflect radiation by the second side section of the first portion 711, and vice versa. Moreover the height h (e.g., about 5.8 mm) of the vertical portions 811, 813 of the first and second antennas 501, 503 may be adjusted to tune the second resonance frequency. Additionally, the inductance value of the inductor 814 may be adjusted to tune the second resonance frequency. The length l of the vertical portions 811, 813 of the first and second antennas 501, 503 over the second side section of the first portion 711 may also be adjusted to tune resonant frequencies of the low band.

Figure 9:
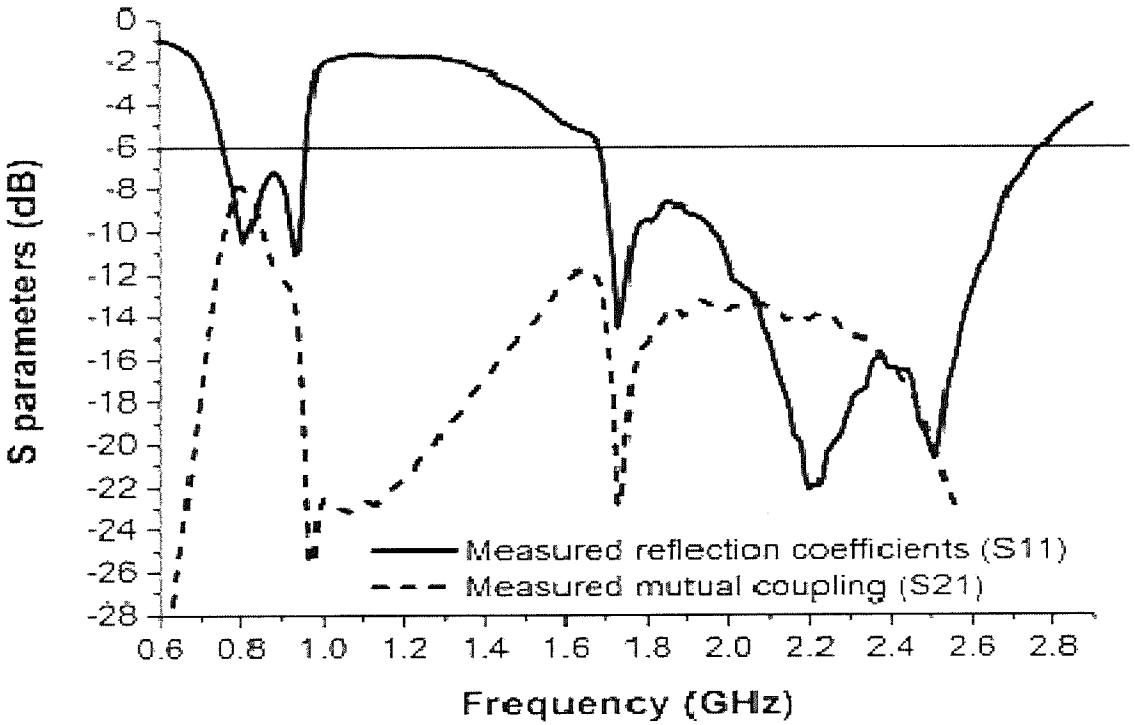
FIG. 9 illustrates reflection coefficients and mutual coupling levels, according to some embodiments of the present inventive concept.

FIG. 9 provides an illustration of reflection coefficients and mutual coupling levels, according to some embodiments of the present inventive concept. For example, FIG. 9 illustrates that the reflection coefficients for the first and second antennas 501, 503 are between about −6 dB and −12 dB for a low band (e.g., about 760 MHz-960 MHz), and between about −6 dB and −24 dB for a high band (e.g., about 1.7 GHz-2.7 GHz). The reflection coefficients for each of the first and second antennas 501, 503 overlap (e.g., are shown as a single curve in FIG. 9) because of the symmetrical structures of the first and second antennas 501, 503. Alternatively, if the first and second antennas 501, 503 are asymmetrical, then their reflection coefficients may be non-overlapping. FIG. 9 also illustrates mutual coupling between first and second antennas 501, 503. In particular, FIG. 9 illustrates that the coupling level between the first and second antennas 501, 503 is lower/improved in comparison with conventional antennas. Accordingly, the reflection coefficients and the mutual coupling levels in FIG. 9 illustrate that the first and second antennas 501, 503 have good isolation. Moreover, although the reflection coefficients and the mutual coupling are illustrated at different levels in FIG. 9, it should be noted that the reflection coefficients and the mutual coupling may be the same in some embodiments.

FIG. 10 illustrates a table of complex correlation coefficients, according to some embodiments of the present inventive concept. In particular, FIG. 10 illustrates relatively low complex correlation coefficients (e.g., lower than about 0.8) and relatively high efficiency (e.g., greater than about 40%) for a low band (e.g., about 760 MHz-960 MHz) and a high band (e.g., about 1.7 GHz-2.7 GHz) when using the first and second antennas 501, 503 and the parasitic element 502. In contrast, conventional antennas may have a high correlation coefficient (the mathematical square of the complex correlation coefficient) in low bands, thus degrading MIMO performance. Accordingly, FIG. 10 illustrates that the compact design using the first and second antennas 501, 503 and the parasitic element 502 may provide good MIMO performance.

Figure 11A:
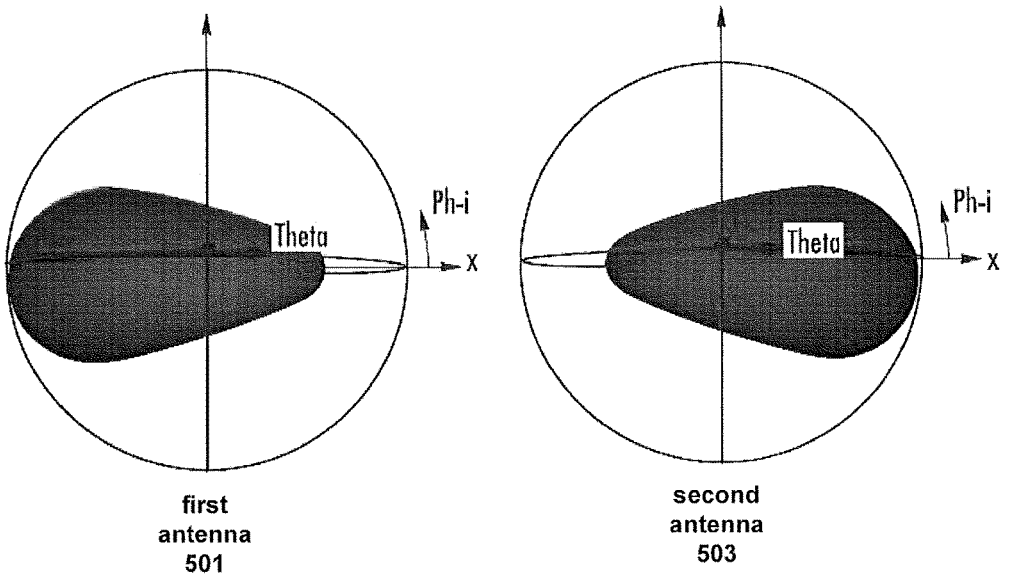
FIGS. 11A and 11B illustrate radiation patterns for the first and second antennas, according to some embodiments of the present inventive concept.
Figure 11B:
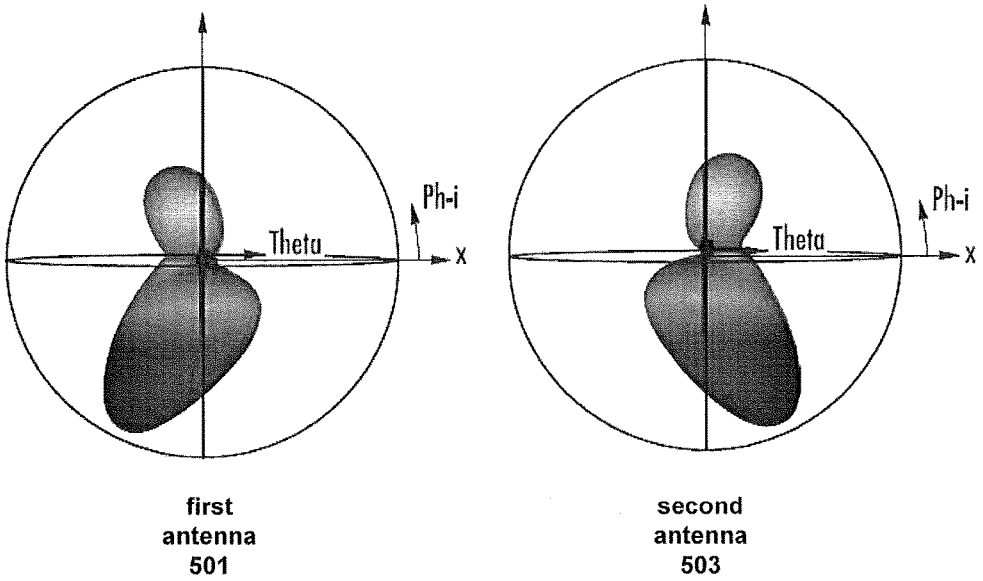

FIGS. 11A and 11B illustrate radiation patterns for the first and second antennas 501, 503, according to some embodiments of the present inventive concept. In particular, FIG. 11A illustrates radiation patterns for the first and second antennas 501, 503 at a low band frequency of about 760 MHz, and FIG. 11B illustrates radiation patterns for the first and second antennas 501, 503 at a high band frequency of about 2.3 GHz. As the radiation patterns for the first and second antennas 501, 503 are different (e.g., substantially opposite/mirror images) from each other in both the low band (FIG. 11A) and the high band (FIG. 11B), this indicates that the radiation patterns have been separated effectively. Accordingly, the radiation patterns of FIGS. 11A and 11B are a further indication that the compact design using the first and second antennas 501, 503 and the parasitic element 502 may provide good MIMO performance.

Figure 12:
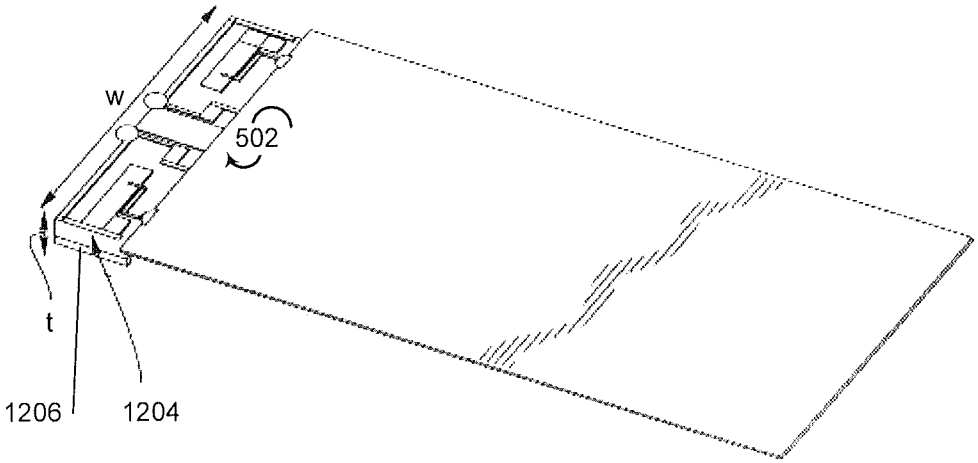
FIG. 12 illustrates a dielectric box used with the first and second antennas, according to some embodiments of the present inventive concept.

FIG. 12 illustrates a dielectric block 1204 (e.g., a dielectric box), according to some embodiments of the present inventive concept. The dielectric block 1204 may further reduce the size of the antenna portion 310 of the wireless terminal 120. For example, the width w of the antenna portion 310 including the dielectric block 1204 may be less than about 55 mm, and the thickness t may be less than about 5.0 mm. In contrast, without the dielectric block 1204, the antenna portion 310 may have a width w of about 60 mm and a thickness t of about 7.0 mm.

The dielectric block 1204 may be a high permittivity (e.g., a permittivity of about six (6)) low loss dielectric block. For example, the dielectric block 1204 may include glass and/or plastic materials. Also, the shape of the dielectric block 1204 may be rectangular, elliptical, or one of various other geometric shapes. Moreover, the dielectric block 1204 may be substantially solid or may include hollow portions (e.g., the dielectric block 1204 may have the shape of a box lid/top).

The first and second antennas 501, 503 and the parasitic element 502 may be provided on multiple sides of the dielectric block 1204. For example, the horizontal portions of the first and second antennas 501, 503 and the parasitic element 502 may be on one side of the dielectric block 1204, and the vertical portions 811, 813, and 812 of the first and second antennas 501, 503 and the parasitic element 502, respectively, may be on another side (e.g., a perimeter/outer edge) of the dielectric block 1204. Moreover, an antenna carrier 1206 (e.g., a plastic material) may be provided on one side of the dielectric block 1204. For example, the antenna carrier 1206 may be provided on the opposite side of the dielectric block 1204 from the horizontal portions of the first and second antennas 501, 503 and the parasitic element 502.

FIG. 13 illustrates a table of complex correlation coefficients for a design that incorporates the dielectric block 1204, according to some embodiments of the present inventive concept. In particular, FIG. 13 illustrates that incorporating the dielectric block 1204 does not significantly degrade the complex correlation coefficients and efficiencies (in comparison with the results in FIG. 10 for a design without the dielectric block 1204). As such, using the dielectric block 1204 with the first and second antennas 501, 503 and the parasitic element 502 allows for a very compact design while providing improved (e.g., lower) correlation coefficients than conventional antennas. Accordingly, FIG. 13 illustrates that the highly compact design incorporating the dielectric block 1204, the first and second antennas 501, 503, and the parasitic element 502 may provide good MIMO performance.

Figure 14:
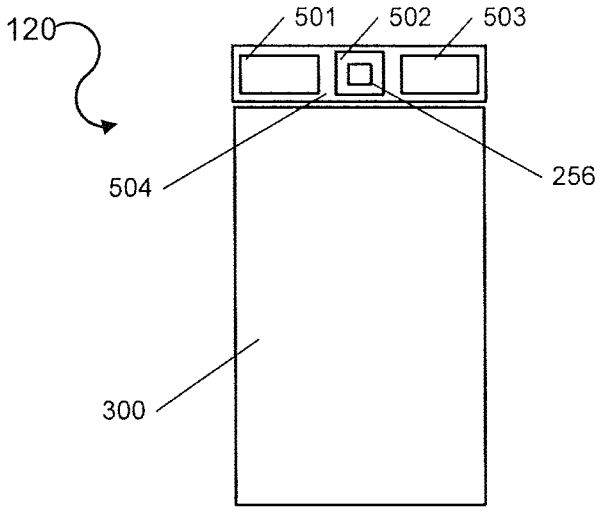
FIG. 14 illustrates a speaker on the parasitic element, according to some embodiments of the present inventive concept.

FIG. 14 illustrates a speaker 256 on the parasitic element 502, according to some embodiments of the present inventive concept. Accordingly, the speaker 256 may be between the first and second antennas 501, 503 along the end portion of the backplate 300. The speaker 256 may be on one or more of various sides of the parasitic element 502. For example, if the parasitic element 502 is on the dielectric block 1204, and if the dielectric block 1204 has a hollow portion (e.g., if the dielectric block 1204 has a box lid/top shape), then the speaker 256 may be provided in the hollow portion of the dielectric block 1204. As such, the speaker 256 may be on the opposite side of the parasitic element 502 from the horizontal portion illustrated in FIG. 8. Moreover, an antenna housing (e.g., a hollow portion of the dielectric block 1204, or a different element) may cover the first and second antennas 501, 503 and provide an acoustic cavity for the speaker 256, thus improving acoustic quality. Furthermore, it should noted that although the speaker 256 is illustrated on the parasitic element 502, other elements (e.g., an audio jack) that may be connected to the ground plane may be integrated into the antenna portion 310 of the wireless terminal 120.

FIG. 15 illustrates a table of complex correlation coefficients for a design that incorporates the speaker 256, according to some embodiments of the present inventive concept. In particular, FIG. 15 illustrates that incorporating the speaker 256 does not significantly degrade the complex correlation coefficients and efficiencies (in comparison with the results in FIGS. 10 and 13 for a design without the speaker 256). As such, using the speaker 256 with the first and second antennas 501, 503 and the parasitic element 502 allows for a compact design while providing improved (e.g., lower) correlation coefficients than conventional antennas. Accordingly, FIG. 15 illustrates that the compact design incorporating the speaker 256, the first and second antennas 501, 503, and the parasitic element 502 may provide good MIMO performance.

Figure 16A:
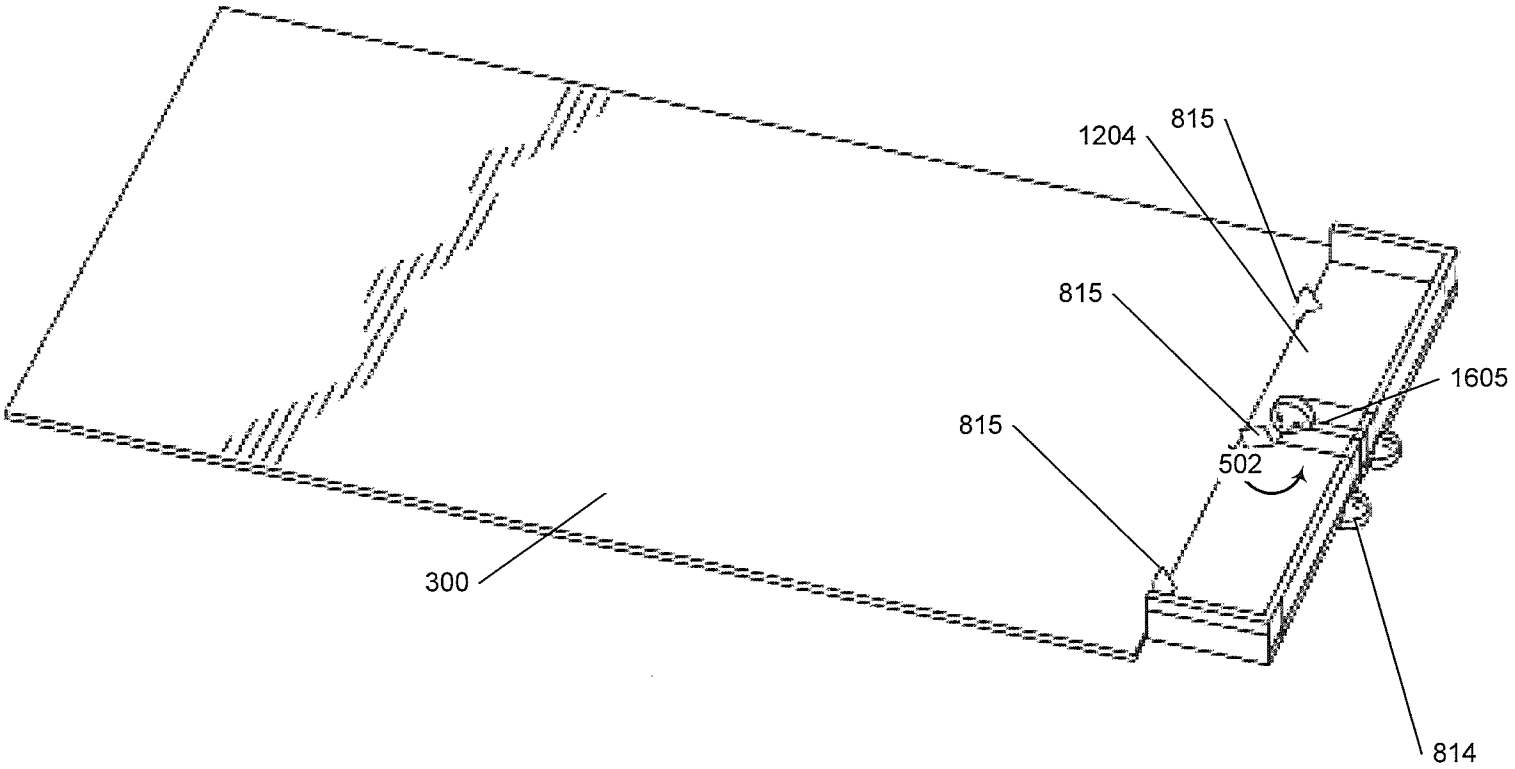
FIGS. 16A-16C illustrate a third antenna, according to some embodiments of the present inventive concept.
Figure 16B:
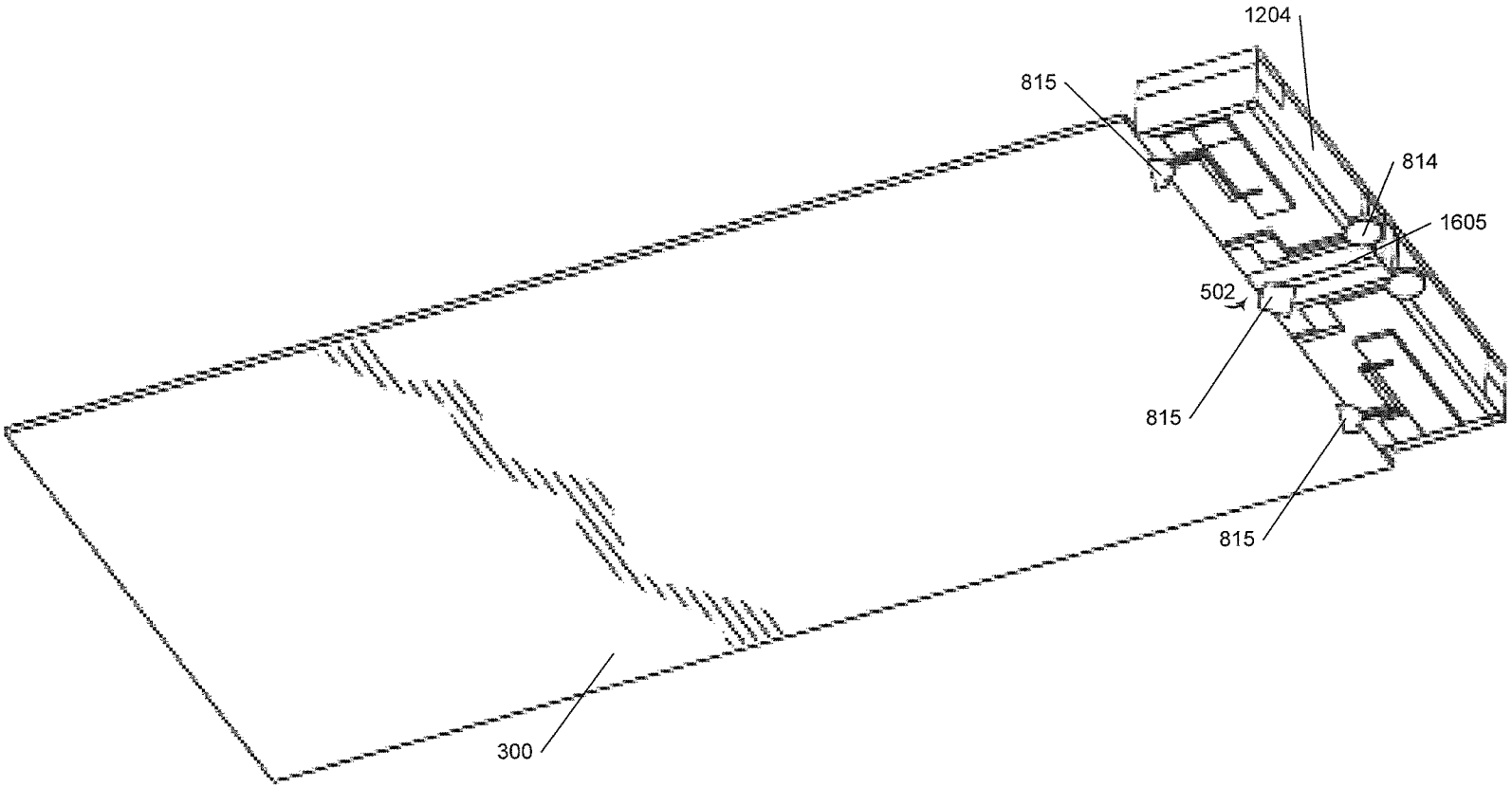
Figure 16C:
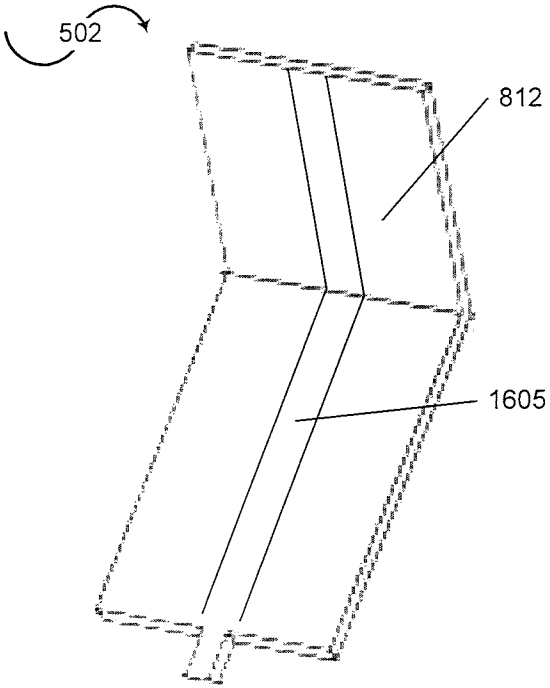

FIGS. 16A-16C illustrate a third antenna 1605, according to some embodiments of the present inventive concept. The third antenna 1605 may be integrated with the parasitic element 502 of the antenna portion 310. In some embodiments, the third antenna 1605 between the first and second antennas 501, 503 (e.g., two MIMO antennas) may be a GPS antenna and/or a WLAN (e.g. Wi-Fi) antenna, and/or may be a notch or ceramic loaded patch antenna. For example, the third antenna 1605 may be a notch/slot antenna on/in the parasitic element 502 between the first and second antennas 501, 503. In some embodiments, the third antenna 1605 may be a receive-only antenna (e.g., a GPS antenna). Additionally, the compact design incorporating the third antenna 1605, the first and second antennas 501, 503, and the parasitic element 502 may provide good MIMO performance.

FIGS. 16A and 16B illustrate opposite sides of the backplate 300 and the dielectric block 1204. In particular, FIG. 16A illustrates that the dielectric block 1204 may include a hollow portion (e.g., the dielectric block 1204 may have a box lid/top shape), and that the parasitic element 502 and the third antenna 1605 may be on the hollow portion of the dielectric block 1204, as well as on a vertical/perimeter edge portion of the dielectric block 1204 and a horizontal portion opposite the hollow portion. FIG. 16B illustrates the horizontal portion of the dielectric block 1204 that is opposite the hollow portion. For example, FIG. 16B illustrates that this horizontal portion of the dielectric block 1204 may be substantially parallel with a primary surface of the backplate 300. Also, a perimeter portion of the horizontal portion of the dielectric block 1204 may share a boundary with a perimeter portion of the end portion of the backplate 300.

FIG. 16C illustrates an enlarged view of the parasitic element 502 and the third antenna 1605. For example, FIG. 16C illustrates that the third antenna 1605 may be located in both horizontal and vertical 812 portions of the parasitic element 502. Alternatively, in some embodiments, the third antenna 1605 may be located in the horizontal portion of the parasitic element 502 but not the vertical portion 812, or vice versa.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description including the manner and process of making and using these embodiments, and shall support claims to any such combination or subcombination.

In the drawings and specification, there have been disclosed various embodiments and, although specific terms are employed, they are used in a generic and descriptive sense only and not for purposes of limitation.

What is claimed is:

1. A multi-band wireless communications terminal comprising:

a backplate covering a multi-band transceiver circuit configured to provide communications for the multi-band wireless communications terminal via a plurality of frequency bands;

first and second antennas spaced apart from each other along an end portion of the backplate, wherein the multi-band transceiver circuit is configured to communicate through the first and second antennas via the plurality of frequency bands, wherein each of the first and second antennas comprises first and second spaced-apart portions, the first portion partially surrounding the second portion; and a parasitic element between the first and second antennas along the end portion of the backplate, wherein a first side section of the first portion is between the second portion and the parasitic element, wherein a second side section of the first portion is spaced apart from the second portion by a first distance, wherein an end section between the first and second side sections of the first portion is spaced apart from the second portion by a second distance longer than the first distance, and wherein a first width, in a direction of the second distance, of the end section of the first portion is substantially narrower than a second width of the second portion in the direction.

2. The multi-band wireless communications terminal of claim 1, wherein each of the first and second antennas comprises a radiating element and a scattering element configured to reflect radiation from the radiating element.

3. The multi-band wireless communications terminal of claim 1, wherein:

the second side section of the first portion is spaced apart from the second portion by less than about 0.8 millimeters; and the end section between the first and second side sections of the first portion is spaced apart from the second portion by less than about 1.4 millimeters.

4. The multi-band wireless communications terminal of claim 1, wherein the first portion surrounds a majority of a perimeter of the second portion.

5. The multi-band wireless communications terminal of claim 1, further comprising a speaker on the parasitic element between the first and second antennas along the end portion of the backplate.

6. The multi-band wireless communications terminal of claim 5, further comprising an antenna housing configured to cover the first and second antennas, and further configured to provide an acoustic cavity for the speaker.

7. The multi-band wireless communications terminal of claim 1, further comprising a third antenna on the parasitic element between the first and second antennas.

8. The multi-band wireless communications terminal of claim 7, wherein the third antenna comprises a Global Positioning System (GPS) antenna.

9. The multi-band wireless communications terminal of claim 1, further comprising a dielectric block along the end portion of the backplate, wherein the first and second antennas and the parasitic element are on the dielectric block.

10. The multi-band wireless communications terminal of claim 9, wherein:

each of the first and second antennas is on first and second sides of the dielectric block;

the first side of the dielectric block is substantially parallel with a primary surface of the backplate; and the second side of the dielectric block comprises an outer edge of the dielectric block.

11. The multi-band wireless communications terminal of claim 9, wherein the first side of the dielectric block comprises a perimeter portion that shares a boundary with a perimeter portion of the end portion of the backplate.

12. The multi-band wireless communications terminal of claim 9, wherein the dielectric block has a width of less than about 55.0 millimeters and a thickness of less than about 5.0 millimeters.

13. The multi-band wireless communications terminal of claim 1, wherein the first and second antennas comprise printed metals.

14. The multi-band wireless communications terminal of claim 1, wherein the parasitic element comprises a printed metal film.

15. A multi-band wireless communications terminal comprising:

a backplate covering a multi-band transceiver circuit configured to provide communications for the multi-band wireless communications terminal via a plurality of frequency bands;

a dielectric material along an end portion of the backplate;

first and second antennas spaced apart from each other on the dielectric material, each of the first and second antennas comprising a radiating element and a scattering element configured to reflect radiation from the radiating element, wherein the multi-band transceiver circuit is configured to communicate through the first and second antennas via the plurality of frequency bands;

a parasitic metal strip between the first and second antennas on the dielectric material; and a third antenna, comprising a Global Positioning System (GPS) antenna, on the parasitic metal strip between the first and second antennas, and connected to a feeding element.

16. The multi-band wireless communications terminal of claim 1, wherein the first portion does not physically contact the second portion.

* * * * *